US009312629B2

(12) United States Patent
Smith et al.

(10) Patent No.: US 9,312,629 B2
(45) Date of Patent: Apr. 12, 2016

(54) PLUG CONNECTOR

(71) Applicant: IDEAL Industries, Inc., Sycamore, IL (US)

(72) Inventors: Nathan T. Smith, Worcester, MA (US); Brian F. Davies, Acton, MA (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 14/610,447

(22) Filed: Jan. 30, 2015

(65) Prior Publication Data

US 2015/0303617 A1 Oct. 22, 2015

Related U.S. Application Data

(60) Provisional application No. 61/934,360, filed on Jan. 31, 2014.

(51) Int. Cl.

| | |
|---|---|
| ***H01R 13/59*** | (2006.01) |
| ***H01R 13/625*** | (2006.01) |
| ***H01R 13/629*** | (2006.01) |
| ***H01R 13/639*** | (2006.01) |
| ***H01R 13/502*** | (2006.01) |

(52) U.S. Cl.

CPC ..... *H01R 13/59* (2013.01); *H01R 13/502* (2013.01); *H01R 13/625* (2013.01); *H01R 13/629* (2013.01); *H01R 13/639* (2013.01)

(58) Field of Classification Search

CPC ..... H01R 13/502; H01R 13/59

See application file for complete search history.

(56) References Cited

U.S. PATENT DOCUMENTS

| | | | | |
|---|---|---|---|---|
| 6,206,714 | B1 | 3/2001 | Bernardini | |
| 6,582,248 | B2 * | 6/2003 | Bachman | H01R 13/516 439/447 |
| 6,808,407 | B1 | 10/2004 | Cannon | |
| 6,814,601 | B2 * | 11/2004 | Lin | H01R 13/59 439/321 |
| 7,164,262 | B2 * | 1/2007 | Zacay | G01K 1/024 324/115 |
| 7,507,105 | B1 | 3/2009 | Peters et al. | |
| 7,726,994 | B1 * | 6/2010 | Willey | A42B 3/042 439/218 |
| 7,740,499 | B1 * | 6/2010 | Willey | H01R 13/625 439/289 |
| 7,938,674 | B2 * | 5/2011 | Lindkamp | H01R 13/59 439/461 |

(Continued)

FOREIGN PATENT DOCUMENTS

| | | | |
|---|---|---|---|
| DE | 202012001298 | U1 | 5/2013 |
| EP | 2492566 | A2 | 8/2012 |
| WO | 2004/105195 | A1 | 12/2004 |

OTHER PUBLICATIONS

ISA/US, International Search Report and Written Opinion issued on PCT application No. US15/13842, date of mailing Apr. 9, 2015, 9 pages.

*Primary Examiner* — Ross Gushi

(74) *Attorney, Agent, or Firm* — Greenberg Traurig, LLP

(57) ABSTRACT

A plug connector includes a back shell defining a sleeve having a projection and a locking bale. A connector shell defining a collar is configured to receive the sleeve of the back shell. The collar includes an axial channel to receive the projection of the back shell and a circumferential channel coupled to the axial channel to allow rotation of the back shell relative to the connector shell. A resilient latch is located over the circumferential channel and arranged to be resiliently deflected by the bale when the back shell is rotated about the longitudinal axis between an inserted position and a locked position. The latch including a retention mechanism to retain the bale when fully rotated into the locked position.

22 Claims, 15 Drawing Sheets

(56) References Cited

U.S. PATENT DOCUMENTS 8,246,377 B2 * 8/2012 Lindkamp ..... H01R 13/5829 439/461
8,313,250 B2 * 11/2012 Drouard ..... G02B 6/4477 174/520
8,398,419 B2 * 3/2013 Coyle, Jr. ..... H01R 13/5219 439/275
8,766,109 B2 * 7/2014 Duval ..... H01R 13/59 174/650
8,777,660 B2 * 7/2014 Chiarelli ..... H01R 13/59 439/584
8,790,128 B2 * 7/2014 Andresen ..... H01R 4/2433 439/320
8,986,038 B2 * 3/2015 Franke ..... H01R 4/30 439/359
9,106,001 B2 * 8/2015 Hagerty ..... H01R 33/971
9,172,179 B2 * 10/2015 Starke ..... H01R 4/2433
9,178,303 B2 * 11/2015 Franke ..... H02G 15/007
2005/0233639 A1 10/2005 Blosch et al.
2006/0144611 A1 * 7/2006 Chiu ..... H01R 9/03 174/74 R
2008/0200056 A1 * 8/2008 Huang ..... H01R 13/59 439/310
2010/0093206 A1 * 4/2010 Chuen ..... H01R 4/2408 439/391
2011/0312211 A1 * 12/2011 Natoli ..... H01R 9/05 439/460
2012/0159740 A1 * 6/2012 Strelow ..... H02G 3/0658 16/2.2
2014/0038456 A1 * 2/2014 Zhao ..... H01R 24/38 439/583
2015/0280360 A1 * 10/2015 Thelen ..... H01R 13/502 439/465
2015/0303617 A1 * 10/2015 Smith ..... H01R 13/625 439/461

* cited by examiner

PLUG CONNECTOR

CROSS REFERENCE TO RELATED APPLICATION

This application is a non-provisional application claiming priority from U.S. Provisional Application Ser. No. 61/934,360, filed Jan. 31, 2014, and incorporated herein by reference in its entirety.

FIELD OF THE DISCLOSURE

The present description relates generally to a coupling mechanism for a plug connector.

BACKGROUND OF RELATED ART

Screw-type latching mechanisms for plug connectors are generally known in the art. For example, European patent publication No. EP2492566A3, describes a connector having a threaded back shell connector for providing a sealed lead-through of cables. The connector includes a tubular housing with an external thread having a first end with a clamping and/or sealing insert, which is actuated by means of a nut screwed onto the first end of the perforated pressure screw and a second end fixed by a hole of a component wall plug and in a desired position by a lock nut or other fastening means. Screw-type latching mechanisms may provide strength, but they are oftentimes difficult and time consuming to assemble.

In other examples, longitudinally axially loaded latch-type coupling mechanisms are also know in the art. For instance, DE 202012001298 describes an electrical connector having an outer housing connectable with an inner housing. The inner housing has axially aligned latching hooks with spring-elastic support arms and projecting latching lug. The outer housing includes a receiving pocket for the latching lug to engage on the outer housing behind a retaining wedge when the outer housing is pushed over the inner housing.

Similarly, US 2005/0233639 describes an electrical plug-in having a longitudinally n axially loaded connector tab. Specifically, the example electrical connector includes a contact carrier and a strain-relief device, wherein a circumferential radial seal is provided on the contact carrier and is inserted in a correspondingly circumferential groove. The strain-relief device, which is in the form of a sleeve, includes three latching recesses. The strain-relief device is pushed axially onto the contact carrier and three latching elements disposed on the contact carrier engage in the latching recesses in the strain-relief device.

While known latch-type mechanisms may provide for relative ease of assembly, the latches themselves must bear any axial load, thereby necessitating a larger and/or stronger material to achieve the same axial resistance as a screw-type latching mechanism. For example, axially loading the connector by pulling typically places a large axial load on the latches, oftentimes resulting in the failure of the connection.

Accordingly, there is a recognized need in the art to provide an electrical plug connector that approximates the strength of a threaded fastener with the ease of a latching mechanism to generally provide for ease of use and strength with a reduced profile and/or material strength requirement.

DETAILED DESCRIPTION

The following description of example methods and apparatus is not intended to limit the scope of the description to the precise form or forms detailed herein. Instead the following description is intended to be illustrative so that others may follow its teachings.

Figure 1:
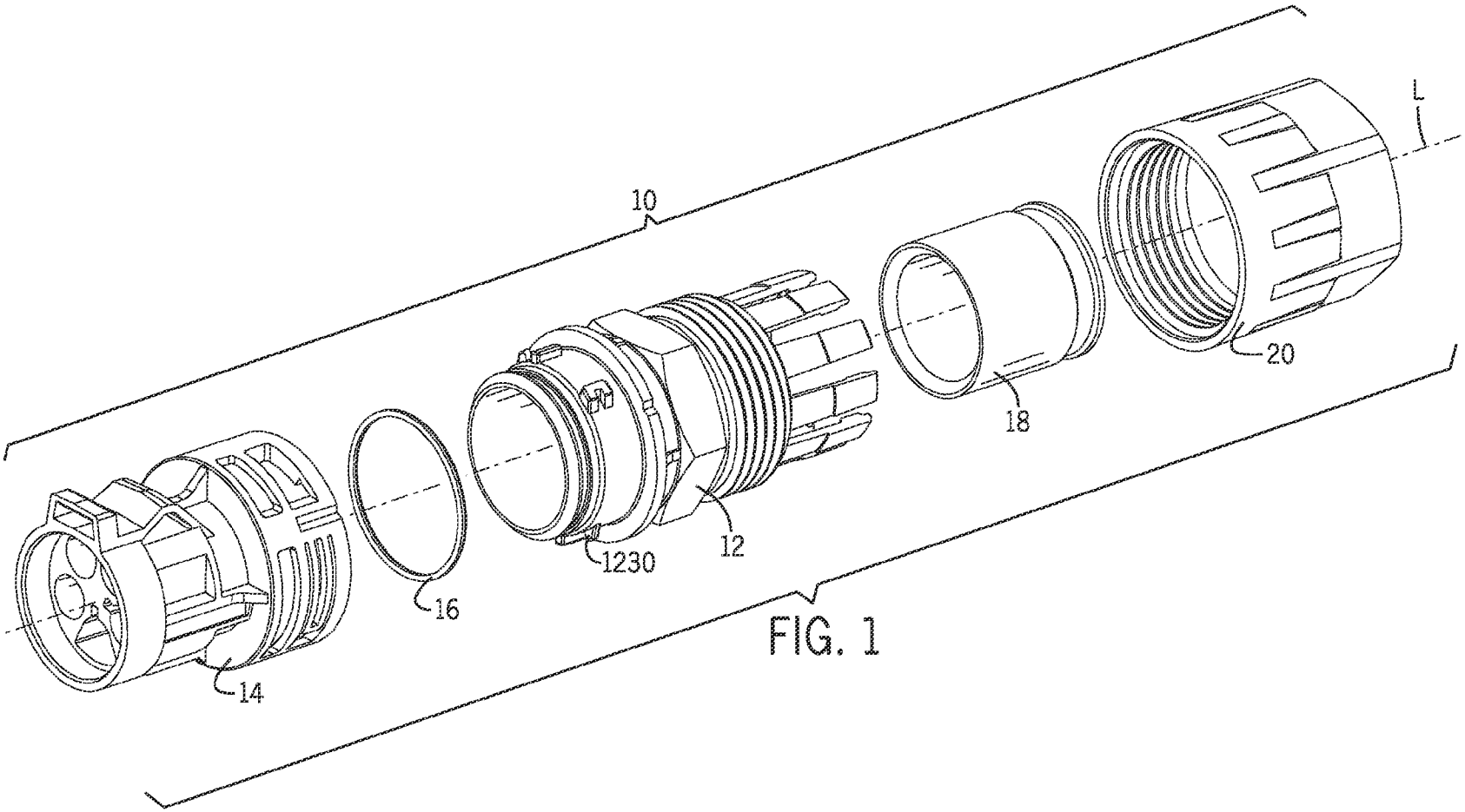
FIG. 1 is an exploded perspective view of an example electrical plug connector in accordance with the present disclosure.

Referring now to FIG. 1, an example connector 10 in accordance with the present disclosure generally includes a back shell 12, a connector shell 14, a back shell seal 16, a cable seal 18, and a pressure nut 20. In this example, each of the back shell 12, the connector shell 14 and the pressure nut 20 are formed from a plastic material. Specifically, the example components are made of Polycarbonate (PC), but it will be appreciate by one of ordinary skill in the art that there are a wide variety of materials, including plastics that could be used. For example, it will be understood that the materials that form the components include, but is not limited to, Nylon, Polybutylene Terephthalate (PBT), PBT+PC blend, etc. In still alternate constructions, the components may be formed from any combination of plastic and/or metal components. For instance, it may be that the housings are constructive of a plastic material, while the actual latching component made of metal (stainless steel or spring steel) and attached to and/or formed with the housing. Still further, in at least one other example, the components may be made entirely of a metal shelled connector that incorporate the type of latch system as disclosed herein.

As shown in FIGS. 1-5, the example back shell 12 is provided with a housing having an external thread 1202 on the outer circumferential surface of the back shell 12. A plurality of clamping tines 1204 at provided at a first end 12*a* of the back shell 12 and extend in the axial direction (i.e., along a longitudinal axis L) of the back shell 12. Each of the tines 1204 are separated by a gap to allow independent deflection of the tines 1204 radially inward and/or outward as necessary. As previously noted, in this example the tines 1204 are formed of a resilient material, such as for example a plastic or other suitable material. A locating lip 1206 is circumferentially provided along the inner surface of the tines 1204. Similarly, a channel 1208 open towards the tines 1204 and is provided on the inner surface of the back shell 12 for limiting the insertion of the cable seal 18 into the back shell 12 as described herein below.

Figure 6:
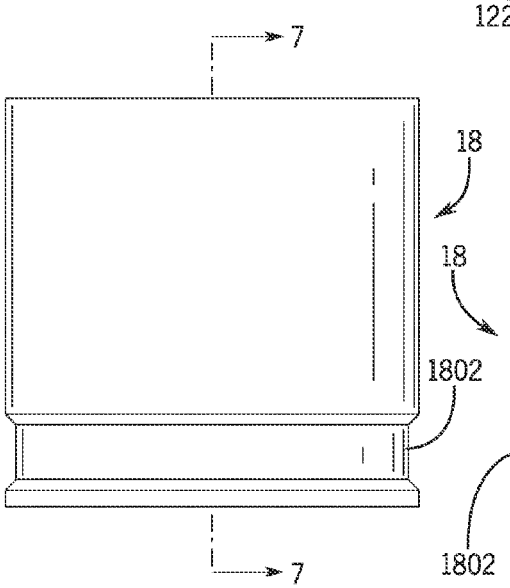
FIG. 6 is a side elevational view of an example cable seal of the present disclosure.
Figure 7:
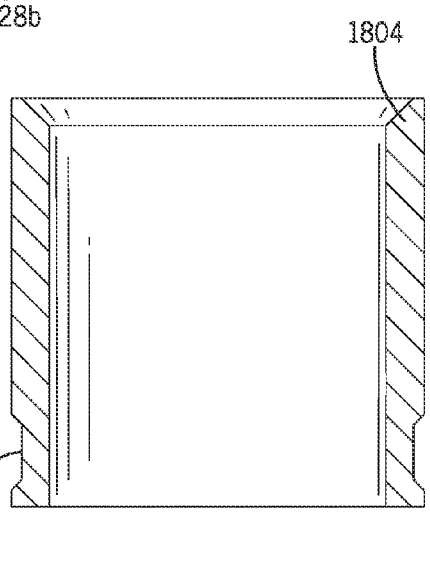
FIG. 7 is a cross sectional view of the example cable seal of FIG. 6.
Figure 8:
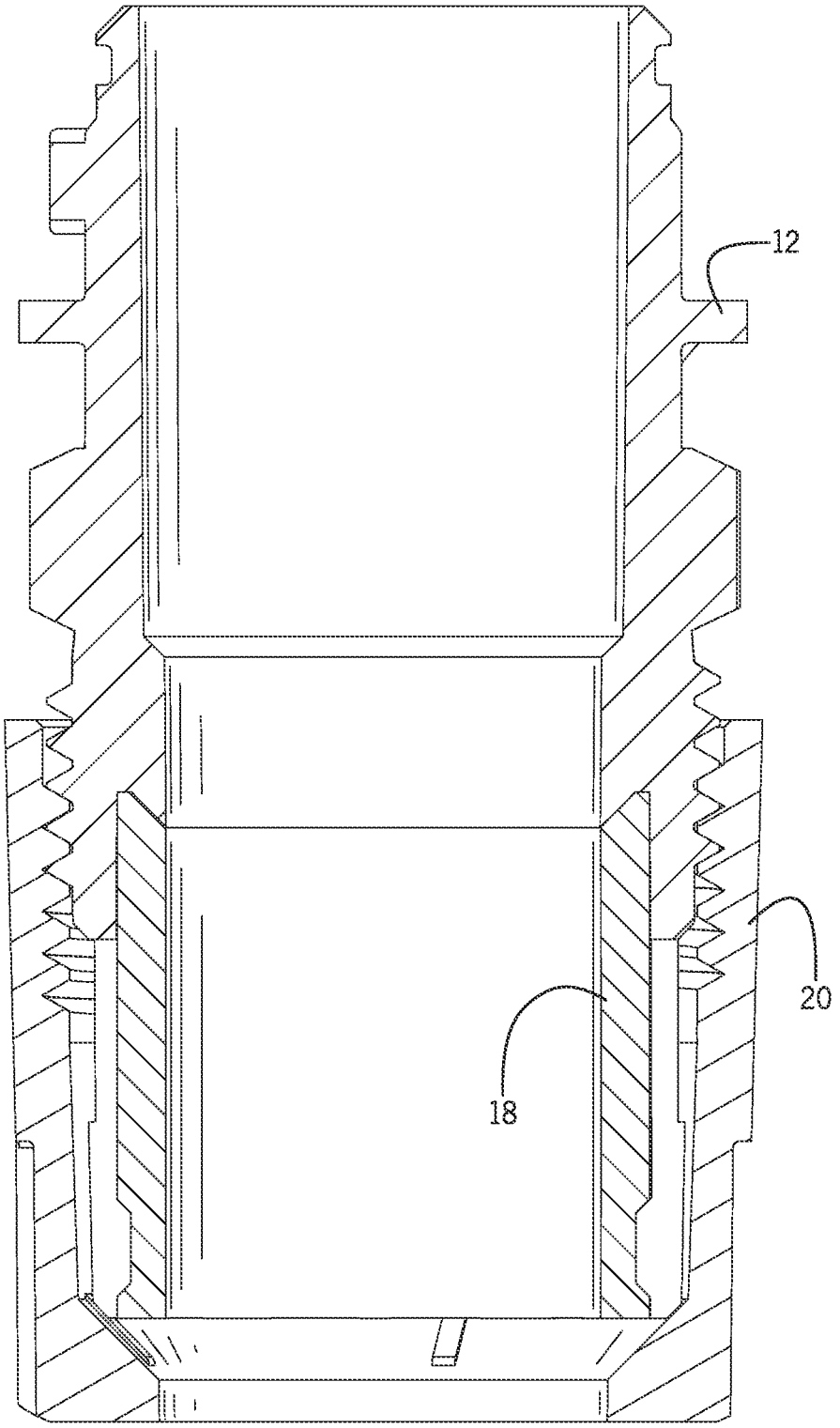
FIG. 8 is a cross sectional view similar to FIG. 4, showing the example back shell as assembled with the example cable seal and an example pressure nut.
Figure 9:
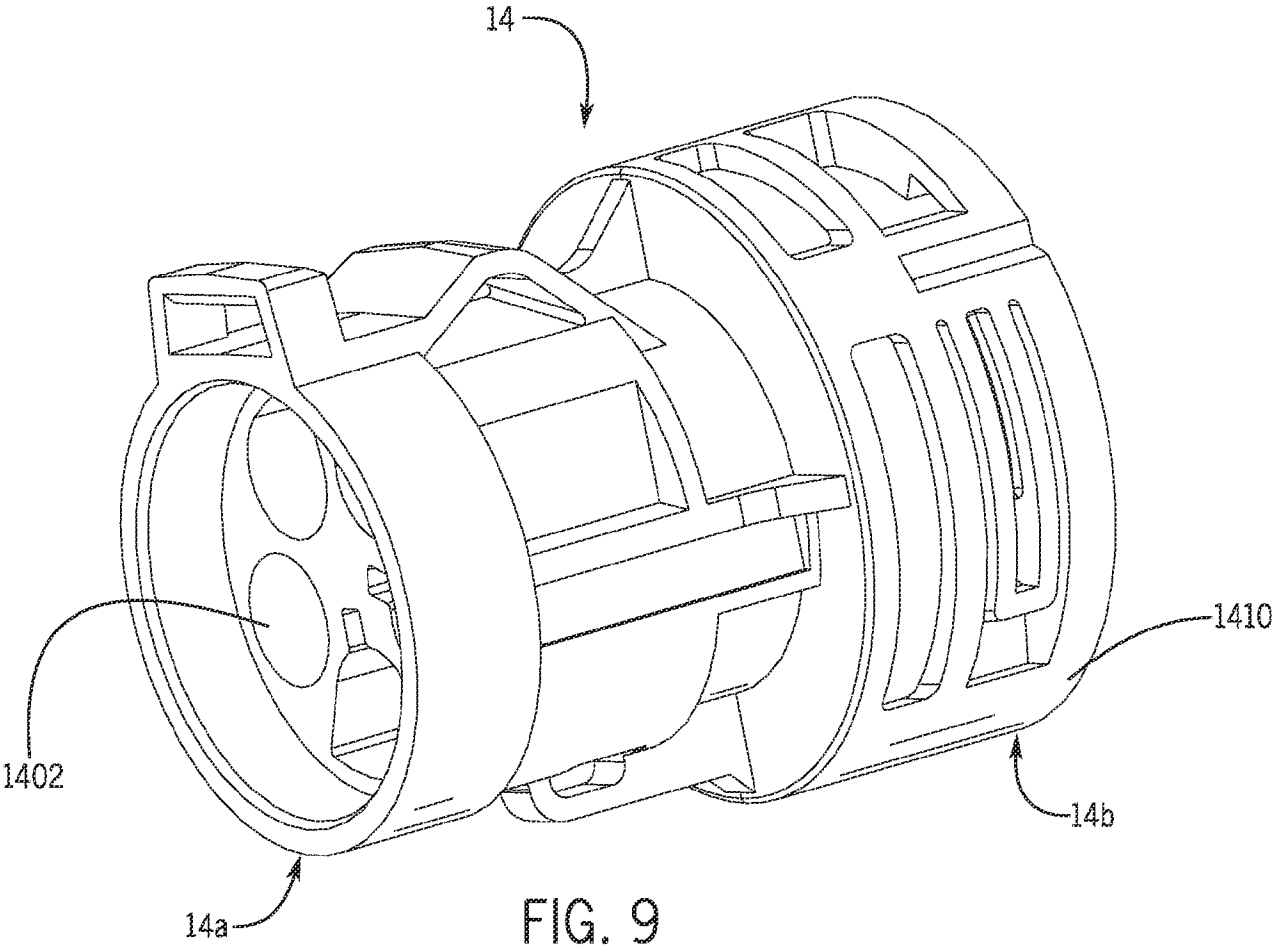
FIG. 9 is a front perspective view of an example connector shell of the present disclosure.
Figure 10:
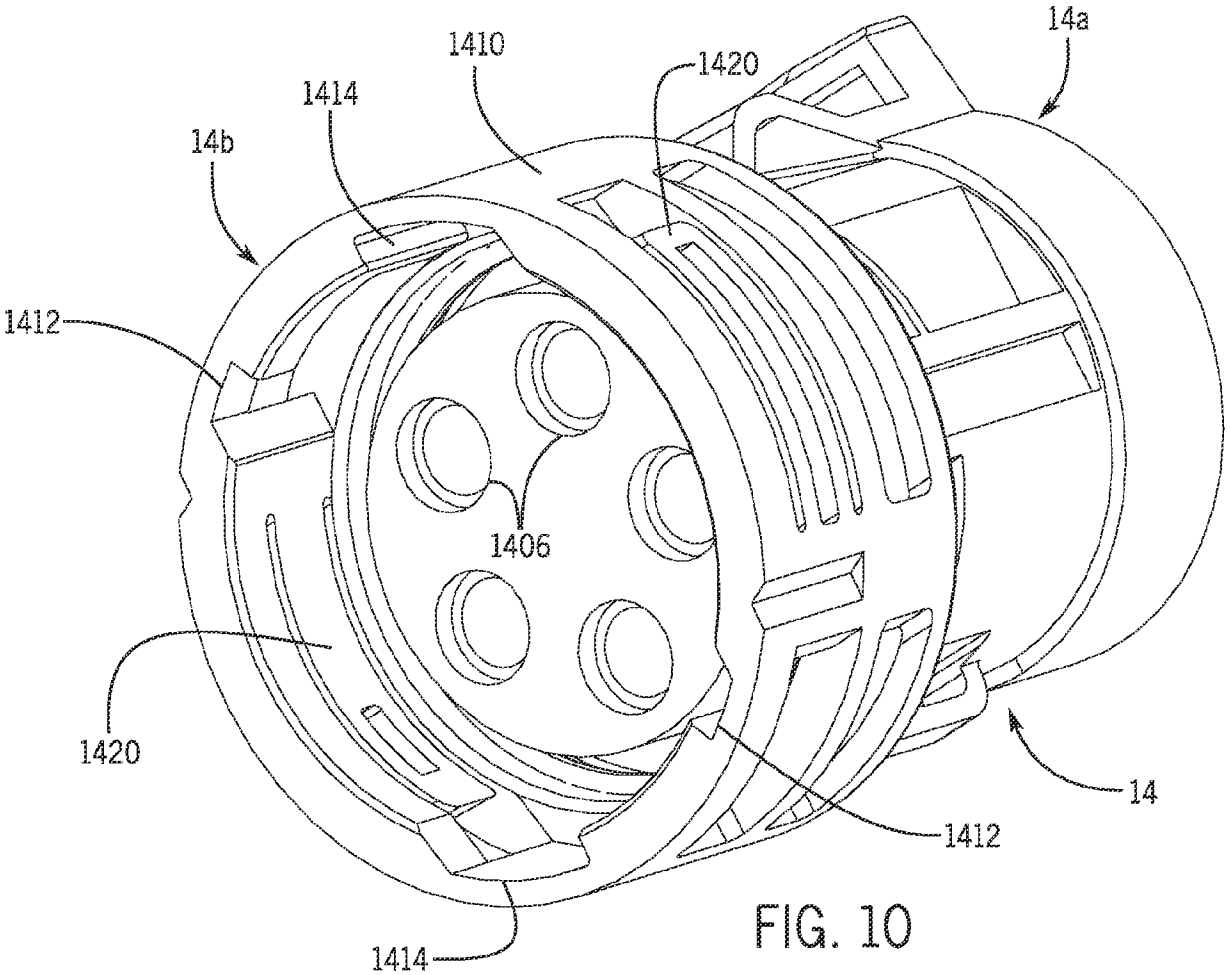
FIG. 10 is a rear perspective view of the example connector shell of FIG. 9.
Figure 11:
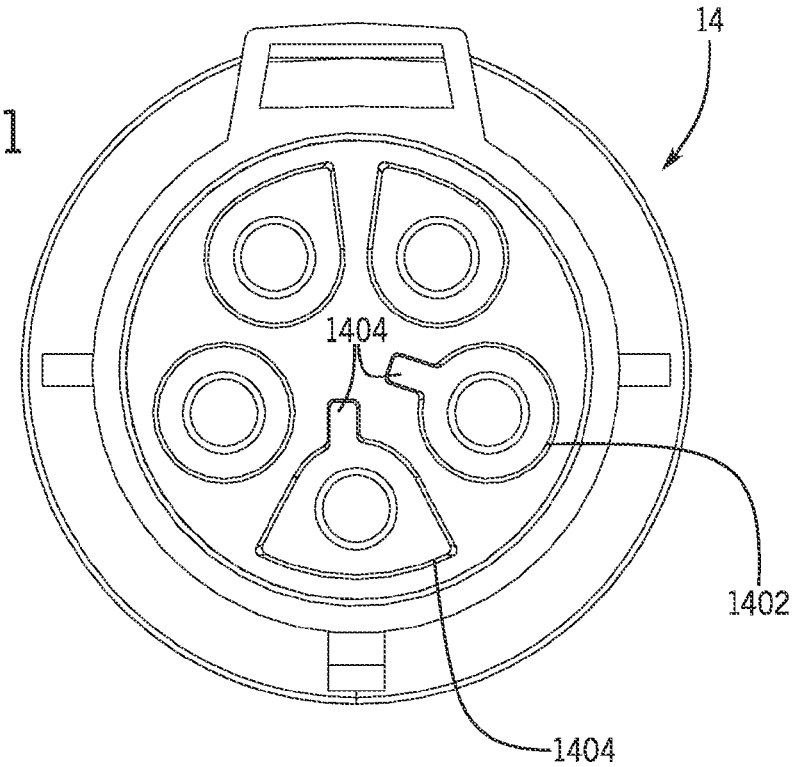
FIG. 11 is a front elevational view of the example connector shell of FIG. 9.
Figure 12:
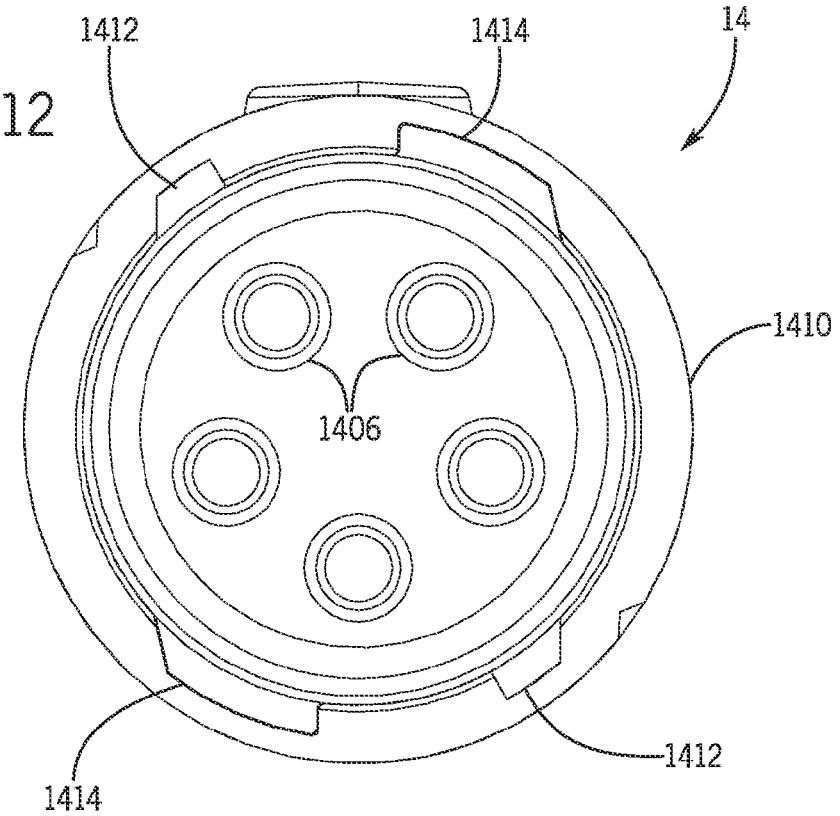
FIG. 12 is a rear elevational view of the example connector shell of FIG. 9.
Figure 13:
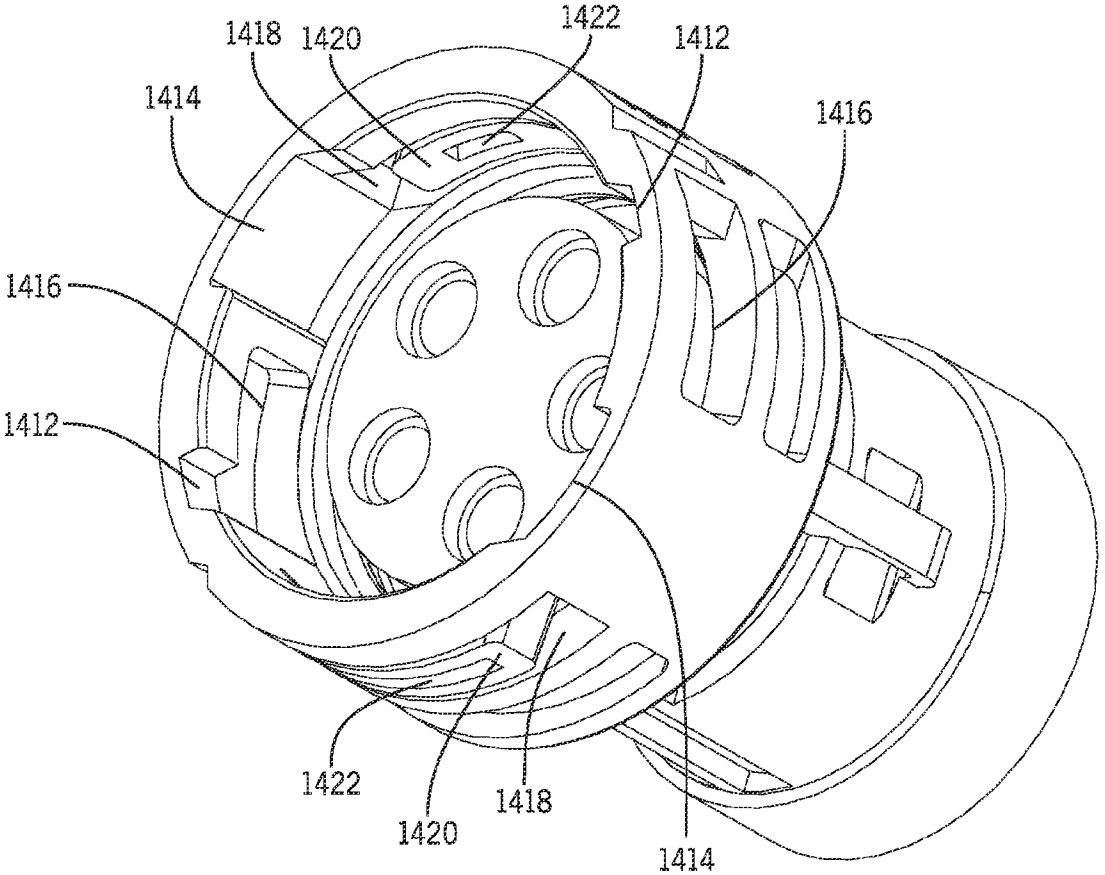
FIG. 13 is another rear perspective view of the example connector shell of FIG. 9.

As seen in FIGS. 6 and 7, a corresponding locating groove 1802 is provided on an outer surface of the cable seal 18 at one end of the seal 18, and at the other end of the cable seal 18 is a chamfered surface 1804. As illustrated in FIG. 8, during operation, the locating groove 1802 is engageable with the locating lip 1206 and the chamfered surface 1804 is configured to be inserted into the channel 1208. The pressure nut 20 may then be tightened to the threaded end of the back shell 12 to press the tines 1204 into engagement with the seal 18. In particular, as will be understood by one of ordinary skill in the art, the process of fixing the example connector 10 to a cable (not shown) includes passing a cable through the pressure nut 20, the cable seal 18, and the back shell 12. As the cable passes through the cable seal 18, and the back shell 12, the locating grove 1802 at the one end of the seal 18 is engaged with the locating lip 1206 on the inner side of the tines 1204, and the other end of the seal 18, specifically the chamfered surface 1804 is inserted into the channel 1208. In this way, the position of the seal 18 is retained at the two ends thereby avoiding the seal 18 from being shifted relative to the cable when properly installed.

Referring again to FIGS. 1-5, a second end 12*b* of the housing of the back shell 12 is provided with a sleeve 1220 configured for insertion into the connector shell 14. In this example, the sleeve 1220 is sized to carry a plurality of electrical wire contacts (not shown) as are well known in the art. For instance, in the illustrated drawings, the sleeve may carry five contacts, corresponding to the apertures defined in the connector shell 14 as well be described. It will be appreciated by one of ordinary skill in the art that the size, type, and/or number of contacts may vary as desired. The example sleeve 1220 includes a flange 1222 extending radially from the outer surface of the sleeve 1220 proximate to the threads 1202. During assembly of the connector 10 the flange 1222 may help in limiting the insertion depth of the back shell 12 into the connector shell 14. A nut 1224 may be optionally provided on the back shell 12, such as for example between the flange 1222 and the threads 1202 to provide a surface for mechanical tightening of the back shell 12 and/or connector 10 as necessary. The distal end of the sleeve 1220 may be provided with a circumferential channel 1226 (FIG. 4) for seating of the back shell seal 16 (e.g., an O-ring; FIG. 3) to provide a seal between the outer surface of the sleeve 1220 and the inner surface of the connector shell 14.

The outer surface of the sleeve 1220 is further provided with a plurality of projections for securely mating the back shell 12 to the connector shell 14. Specifically, in this example, the outer surface of the sleeve 1220 includes a plurality of radial projections 1228 circumferentially spaced around the outer surface of the sleeve 1220, and at least one latching bale 1230. In this example, the radial projections 1228 include a first pair of "C-shaped" projections 1228*a* located on opposite sides of the sleeve 1220, and a second pair of "rectangular-shaped" projections 1228*b*, similarly located on opposite sides of the sleeve 1220. By locating the projections 1228 on opposite sides of the sleeve 1220, the back shell 12 may be coupled to the connector shell 14 in at least two orientations. Of course, it will be appreciated by one of ordinary skill in the art that the shape, number, and/or location of the projections 1228 may vary from one to many as desired to increase or reduce the number of connection orientations or to provide connectors having various strength characteristics.

Figure 2:
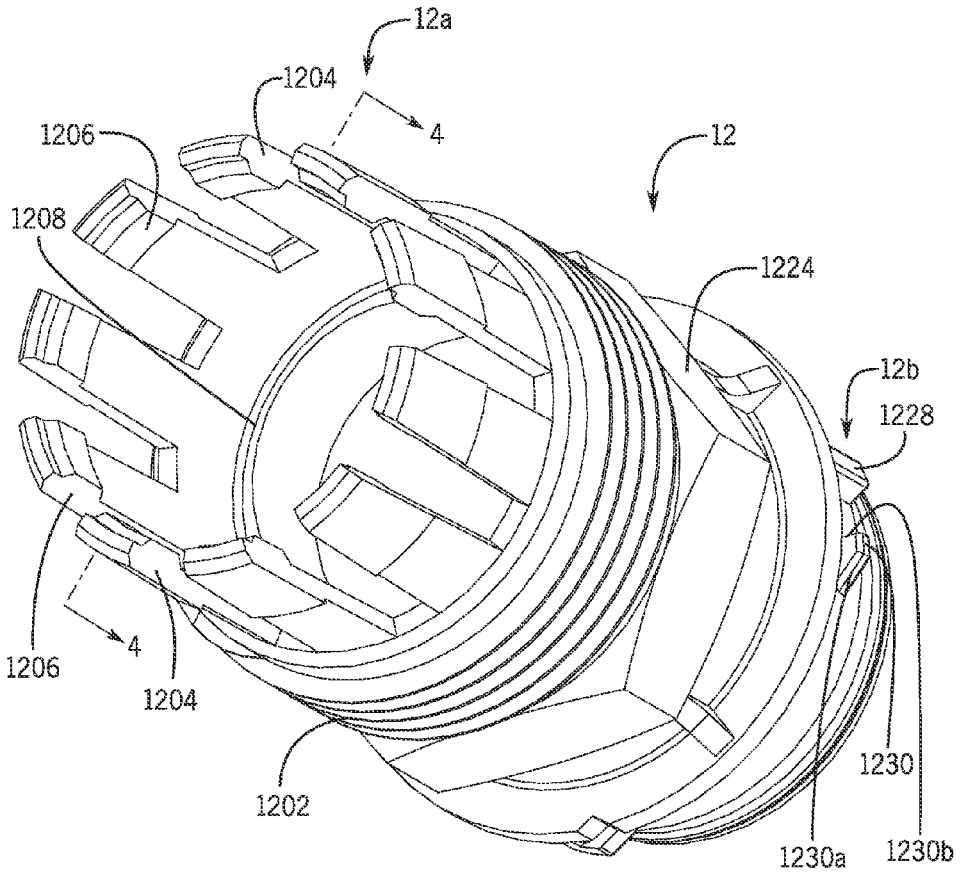
FIG. 2 is a perspective view of an example back shell of the present disclosure.
Figure 4:
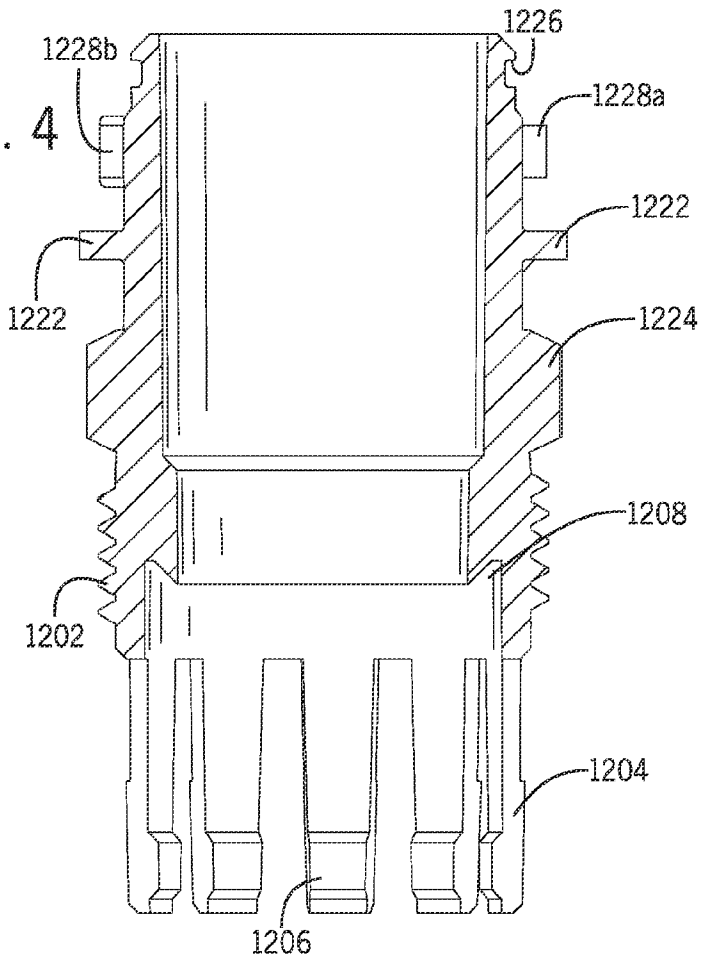
FIG. 4 is a cross sectional view of the example back shell taken along line 4-4 of FIG. 2.
Figure 3:
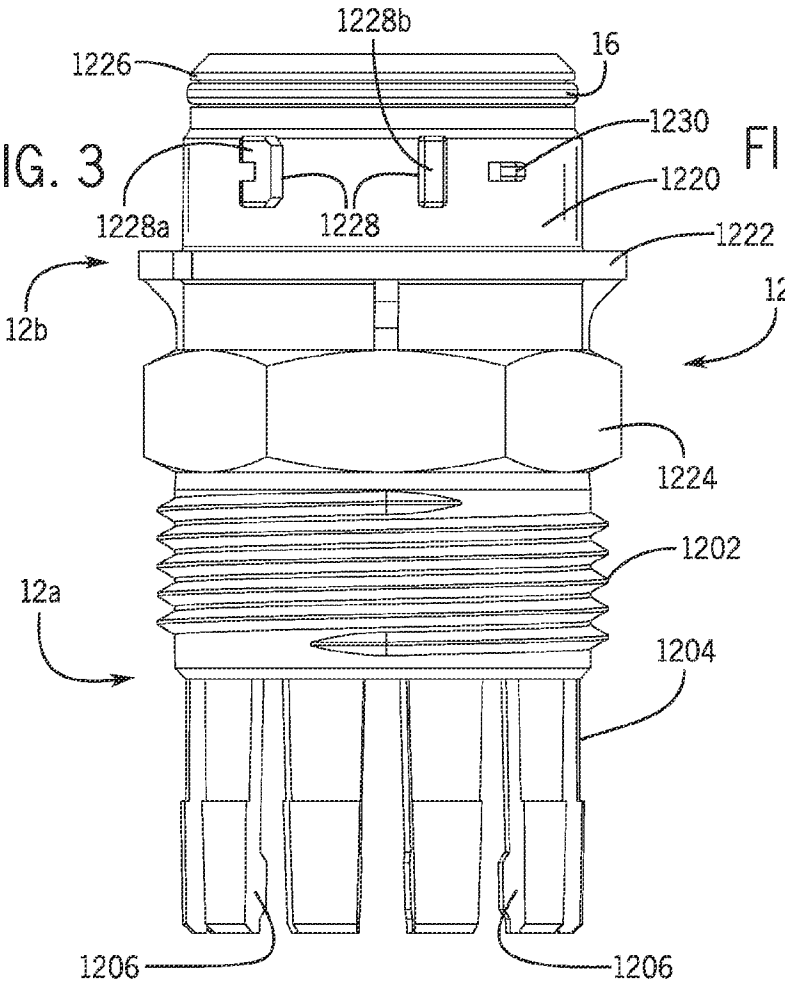
FIG. 3 is a side elevational view of the example back shell of FIG. 2.
Figure 5:
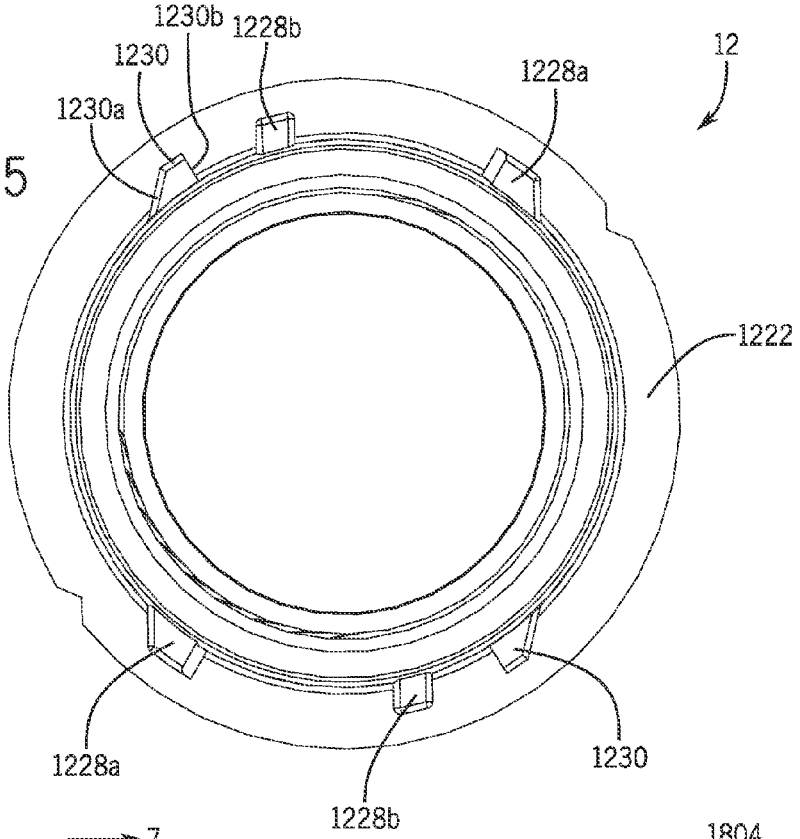
FIG. 5 is an end elevational view of the example back shell of FIG. 2.

As best seen in FIGS. 2 and 5, the example latching bale 1230 includes a ramped surface 1230*a* and an opposite shoulder surface 1230*b*. As will be described in greater detail below, the latching bale 1230 is arranged on the sleeve 1220 such that rotation of the back shell 12 about the longitudinal axis L when fully seated within the connector shell 14 causes the ramped surface 1230*a* to deflect a corresponding latch 1420 on the connector shell 14 and seat the latch against the shoulder surface 1230*b*.

Figure 19:
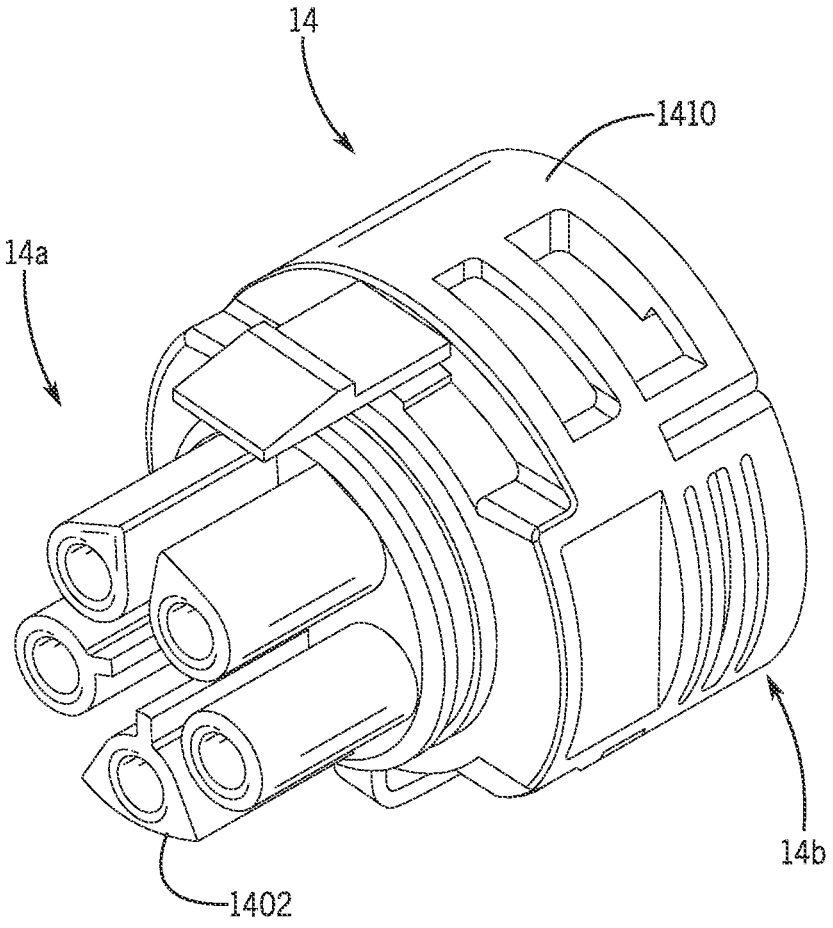
FIG. 19 is a perspective view of another example connector shell of the present disclosure having a male connector.

For instance, turning to FIGS. 9-13, the example connector shell 14 includes a housing having first end 14*a* including a plurality of female connector jackets 1402 configured to mate with a corresponding male jacket on a separate connector (not shown) such as a separate connector 14 having male connector jackets as opposed to female connector jackets. The housing also includes a second end 14*b* having a collar 1410 configured to fit over the sleeve 1220 of the back shell 12. In this example, the end 14*a* includes five female connector jackets 1402 having keyed shapes and/or features 1404 (see FIG. 11) to allow the insertion of the corresponding external male connector (see FIG. 19) in a desired orientation. The ornamental design of the features 1404 of the jackets 1402 including the number, location, shape, depth, size, etc. may be changed as desired. Similarly, as illustrated, the second end 14*b* includes a plurality of contact receiving receptacles 1406 that are configured to retain wire contacts therein.

As previously noted, the second end 14*b* of the example connector shell 14 includes the collar 1410 which is sized to receive the sleeve 1220 within the collar. In this example, the collar includes a plurality of axial channels 1412, 1414 formed in the side wall and exposed through an end wall 1413 of the collar 1410. The first of the axial channels 1412 are size and circumferentially arranged around the perimeter of the collar 1410 to receive the example C-shaped projections 1228*a* therein. Similarly, the second of the axial channels 1414 are sized and arranged to receive one pair of both the rectangular-shaped projection 1228*b* and the latching bale 1230. Each of the axial channels 1412 and 1414 are operatively formed with a corresponding circumferential channel 1416, 1418, respectively, to allow rotation of the projections 1228*a*, 1228*b*, and the latching bale 1230 about the longitudinal axis L when the back shell 12 is fully inserted into the connector shell 14. Furthermore, as previously noted, a resilient latch 1420 is arranged along the perimeter of the collar 1410 and is biased inward such that the latch will retain the latching bale 1230 with a corresponding slot 1422 or other retention mechanism such as an aperture, or other suitable device.

Figure 14:
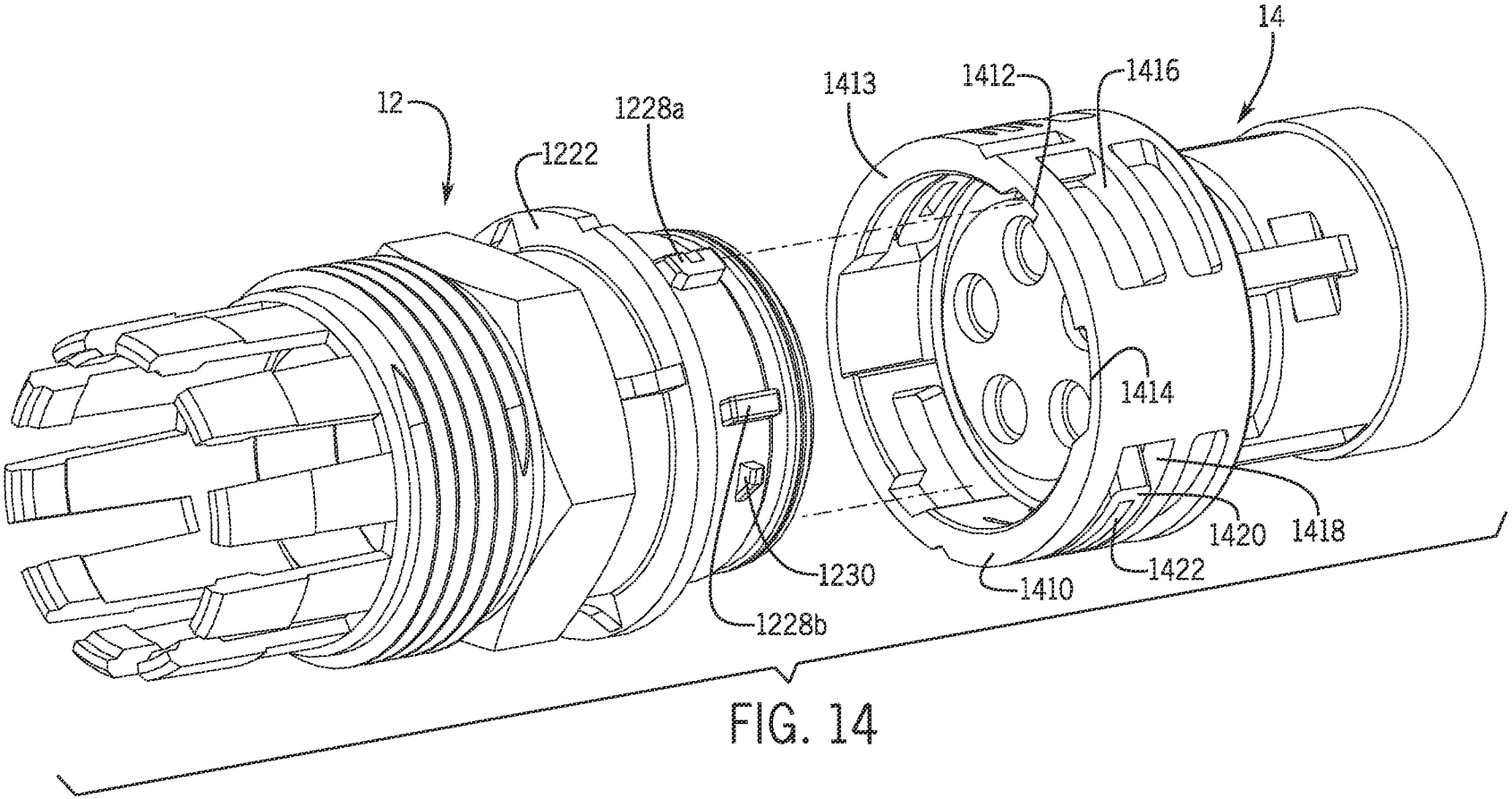
FIG. 14 is a perspective view of the example back shell and the example connector of the present disclosure prior to assembly.

FIGS. 14-18 illustrate the operation of the example connector 10. Specifically, as shown in FIG. 14, the back shell 12 and the connector shell 14 are rotated about the longitudinal axis L until the projections 1228*a*, 1228*b*, and the latching bale 1230 are properly aligned with their corresponding axial channels 1412, 1414. It will be understood by one of ordinary skill in the art that the back shell 12 and the connector shell 14 may not be properly mated until the proper orientation is achieved. Once the correct orientation is achieved, the sleeve 1220 of the back shell 12 is fully inserted into the collar 1410 of the connector shell 14, such as for example, when the end wall 1413 of the collar 1410 contacts the flange 1222, and the projections 1228*a*, 1228*b*, and the latching bale 1230 are properly aligned with their corresponding circumferential channels 1416, 1418. It will also be appreciated by one of ordinary skill in the art that once fully inserted in to the connector shell 14, the sleeve 1220 of the back shell 12, and more particularly the shell seal 16 creates a seal between the outer surface of the sleeve 1220 and the inner surface of the collar 1410.

Figure 15:
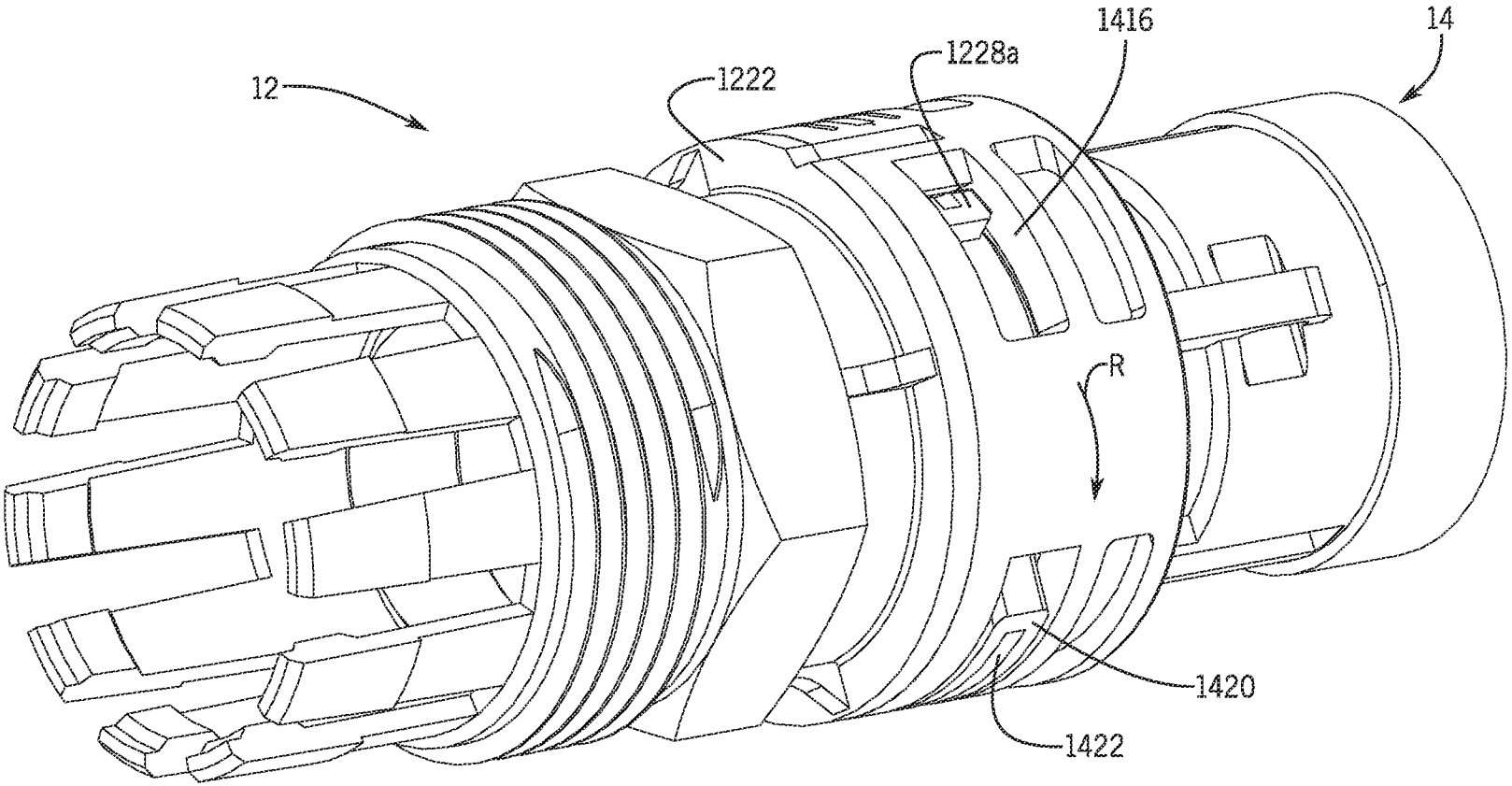
FIG. 15 is a perspective view of the example back shell and the example connector as assembled in an inserted position.
Figure 16:
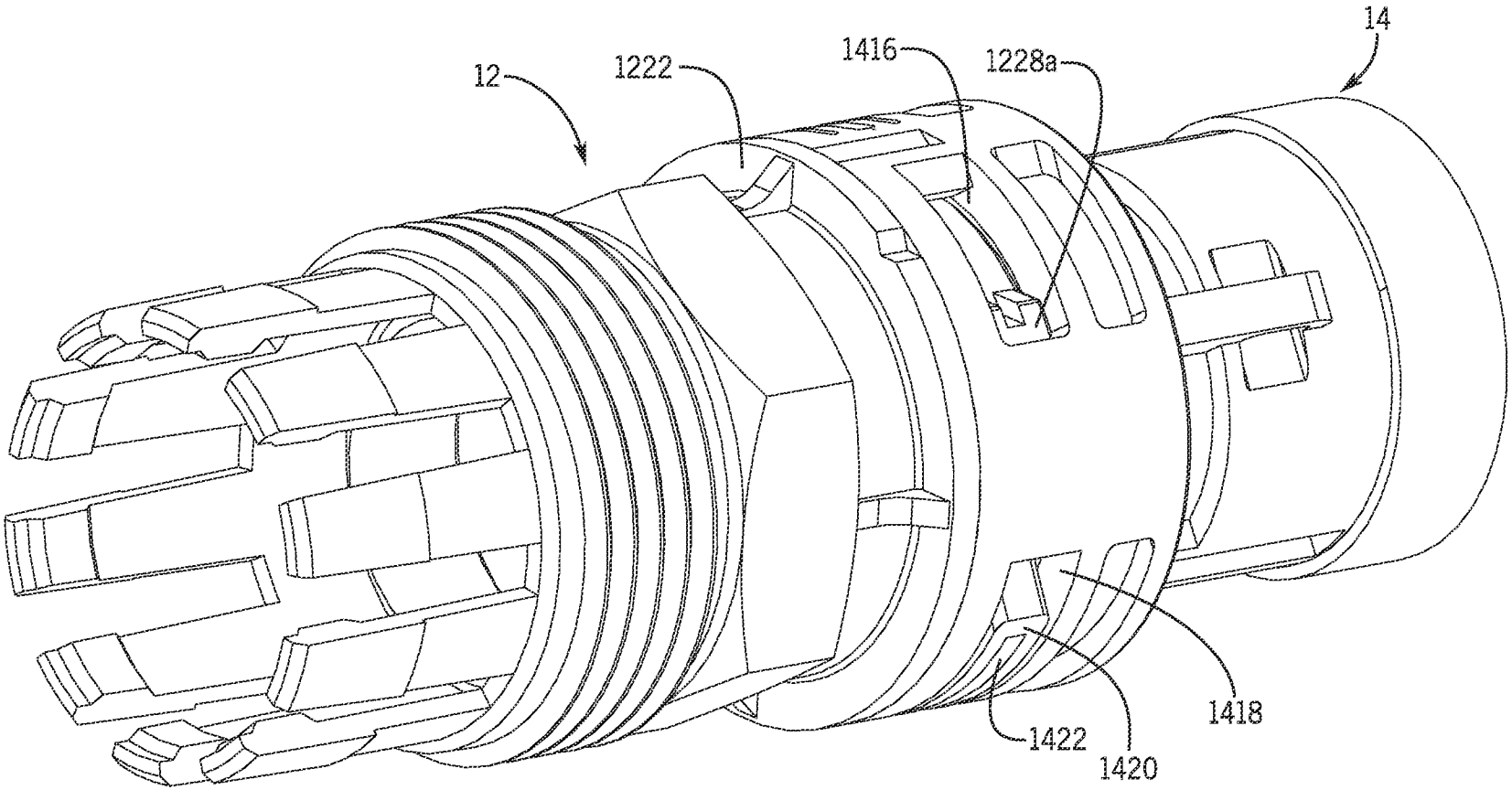
FIG. 16 is a perspective view of the example back shell and the example connector as assembled and rotated into a locked position.
Figure 17:
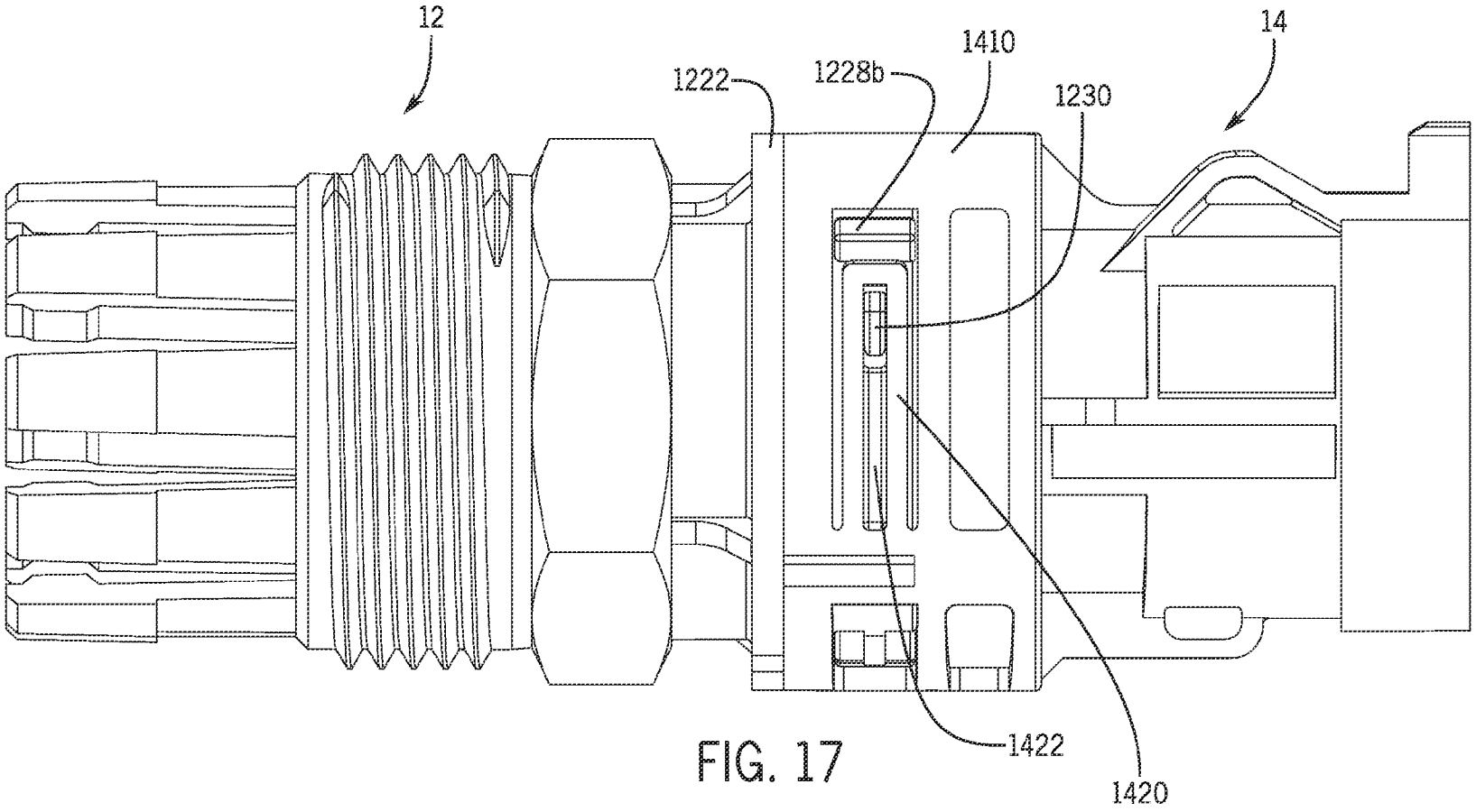
FIG. 17 is a side elevational view of the example back shell and the example connector as assembled and rotated into the locked position.
Figure 18:
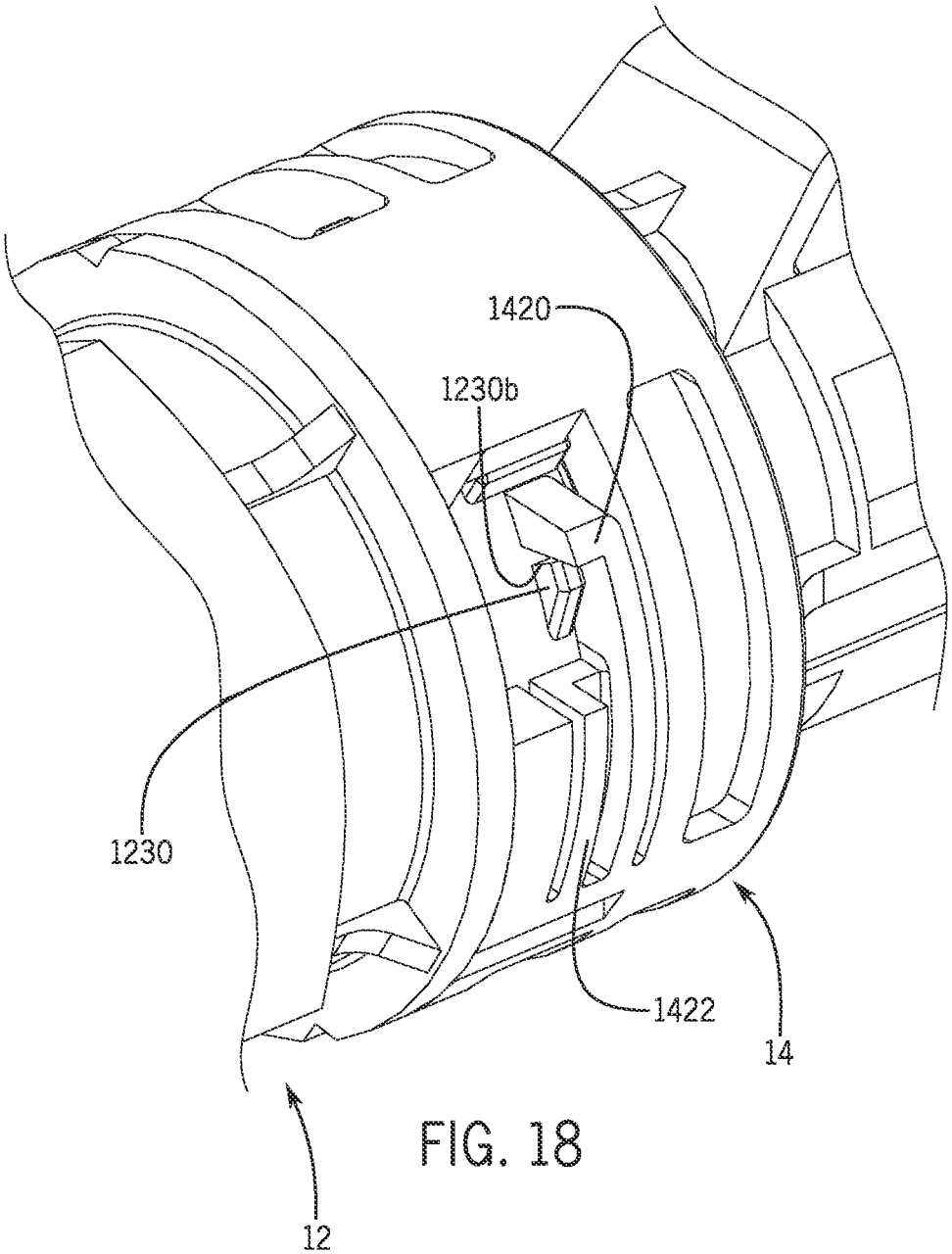
FIG. 18 is an enlarged perspective view of the assembled example back shell and connector shell with a partial cross sectional view showing the latching mechanism.

Still further, once the back shell 12 is fully inserted into the connector shell 14 as illustrated in FIG. 15 (e.g., an inserted position), the back shell 12 may be rotated about the longitudinal axis L relative to the connector shell 14 towards a locked position (e.g. approximately 30°). It will be seen that in this example, rotation of the back shell 12 may only be effected in a single direction R because rotation in a direction opposite to the direction R will be prohibited by the projections 1228*a* and 1228*b* contacting the ends of the respective channel walls. As the back shell 12 is rotated between the inserted position towards the locked position in the direction R, the ramped surface 1230*a* of the bale 1230 contacts the resilient latch 1420 and deflects the latch 1420 outwards. As rotation continues, the bale 1230 passes into the retention mechanism, such as the slot 1422, allowing the latch 1420 to return to its original state and against the shoulder 1230*b*, thereby capturing the bale 1230 within the slot 1422 as illustrated in FIGS. 16 and 17. The projections 1228*a* and 1228*b* prevent further rotation of the back shell 12 relative to the connector shell 14 (i.e., over rotation) by contacting an end wall of the circumferential channel 1416, and by contacting the latch 1420, respectively. Meanwhile, the latch 1420 prevents counter-rotation of the back shell 12 relative to the connector shell 14 by maintaining the bale 1230 within the slot 1422, and the shoulder 1230*b* against the inside of the retention mechanism as shown in FIG. 18.

The example connector 10 thus provides for a connection between the back shell 12 and the connector shell 14 that is quickly and easily performed. Specifically, the connection simple requires a user to insert the back shell 12 into the connector shell 14, and rotate the back shell 12 a predetermined amount to engage the latching mechanism. The back shell 12 does not need to be fully rotated relative to the connector shell 14. Similarly, once fully inserted and rotated, any axial loads in the direction of the longitudinal axis L are distributed through the projections 1228*a*, 1228*b*, to the entirety of the collar 1410, thereby providing enhanced resistance to axial loads without placing addition strain on the latch 1420 and/or bale 1230.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A plug connector comprising:

a back shell defining a sleeve, the sleeve comprising a projection and a bale; and a connector shell defining a collar configured to receive the sleeve of the back shell, the collar comprising:

an axial channel to receive the projection of the back shell and a circumferential channel operative coupled to the axial channel to allow rotation of the back shell relative to the connector shell; and a resilient latch is mounted along the circumferential channel and arranged to be resiliently deflected by the bale when the back shell is rotated about a longitudinal axis between an inserted position and a locked position, the latch including a retention mechanism to retain the bale when fully rotated into the locked position.

2. A plug connector as recited in claim 1, wherein at least one of the back shell or the connector shell comprises a non-metallic material.

3. A plug connector as recited in claim 2, wherein the non-metallic material is at least one of a Polycarbonate, Nylon, Polybutylene Terephthalate, or combination thereof.

4. A plug connector as recited in claim 1, wherein at least one of the back shell or the connector shell comprises a metallic material.

5. A plug connector as recited in claim 1, wherein the back shell further comprises a plurality of clamping tines along the circumference of the back shell opposite the sleeve and extending axially from the back shell.

6. A plug connector as recited in claim 5, wherein the clamping times are each separated by a gap to allow independent deflection of each of the clamping tines.

7. A plug connector as recited in claim 5, wherein at least one of the plurality of clamping times is resiliently deflectable.

8. A plug connector as recited in claim 5, further comprising a tubular cable seal, locatable interior to the clamping tines.

9. A plug connector as recited in claim 5, further comprising a pressure nut configured to be mounted to the back shell exterior to the clamping tines, the pressure nut comprising a reduced diameter interior surface to deflect the clamping tines inward.

10. A plug connector as recited in claim 9, wherein the pressure nut is threadably mounted to the back shell.

11. A plug connector as recited in claim 1, wherein the sleeve is configured to carry a plurality of electrical wire contacts.

12. A plug connector as recited in claim 1, wherein the sleeve comprises a flange extending at least partially from the circumference of the sleeve.

13. A plug connector as recited in claim 12, wherein the flange is configured to arrest insertion of the sleeve into the connector shell.

14. A plug connector as recited in claim 1, wherein the latch comprises an aperture defining the retention mechanism, wherein the bale is retained by the aperture when the back shell is fully rotated into the locked position.

15. A plug connector as recited in claim 14, wherein the aperture is a circumferential slot in the latch.

16. A plug connector as recited in claim 1, wherein the projection contacts a wall of the axial channel in the collar to limit relative rotational movement between the back shell and the connector about the longitudinal axis.

17. A plug connector as recited in claim 1, further comprising a shell seal disposed between an outer surface of the sleeve and an inner surface of the collar.

18. A connector comprising:

a back shell defining a sleeve, the sleeve comprising a plurality of circumferentially spaced projections and at least one bale; and a connector shell defining a collar configured to receive the sleeve of the back shell, the collar comprising:

a plurality of circumferentially spaced axial channels to receive the plurality of projections of the sleeve of the back shell and a plurality of circumferential channels, each circumferential channel operative coupled to one of the axial channels to allow axial insertion of the collar into the sleeve and to allow rotation of the back shell relative to the connector shell about a longitudinal axis; and a resilient latch is mounted along at least one of the circumferential channels, the latch being arranged to be resiliently deflected by the bale when the back shell is rotated about a longitudinal axis toward a locked position, wherein the latch comprises a retention mechanism to retain the bale when fully rotated into the locked position.

19. A connector as recited in claim 18, wherein the sleeve comprises a flange extending at least partially from the circumference of the sleeve.

20. A connector as recited in claim 19, wherein the flange is located to limit insertion of the sleeve into the connector shell.

21. A connector as recited in claim 18, wherein the retention mechanism comprises a circumferential slot, and wherein the bale is retained by the slot when the back shell is fully rotated into the locked position.

22. A connector as recited in claim 18, wherein at least one of the projection contacts an inner wall of at least one of the axial channels in the collar to limit relative rotational movement between the back shell and the connector about the longitudinal axis.

* * * * *